US010189607B2

(12) United States Patent
Tseng et al.

(10) Patent No.: US 10,189,607 B2
(45) Date of Patent: Jan. 29, 2019

(54) PLASTIC FOOD PORTION BAG WITH TACKY FLAP

(71) Applicant: Inteplast Group, Ltd., Livingston, NJ (US)

(72) Inventors: Ben Tseng, East Brunswick, NJ (US); Ter-Hai Lin, Sugar Land, TX (US); Joe Wang, Roseland, NJ (US); Jerry Hsu, Closter, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 35 days.

(21) Appl. No.: 14/665,591

(22) Filed: Mar. 23, 2015

(65) Prior Publication Data

US 2015/0266622 A1 Sep. 24, 2015

Related U.S. Application Data

(60) Provisional application No. 61/968,882, filed on Mar. 21, 2014.

(51) Int. Cl.

| | |
|---|---|
| ***B65D 33/18*** | (2006.01) |
| ***B65D 33/00*** | (2006.01) |
| ***B65D 33/20*** | (2006.01) |

(52) U.S. Cl.

CPC ..... *B65D 33/001* (2013.01); *B65D 33/18* (2013.01); *B65D 33/20* (2013.01)

(58) Field of Classification Search

CPC ..... B65D 33/001; B65D 33/18; B65D 33/20
See application file for complete search history.

(56) References Cited

U.S. PATENT DOCUMENTS

| | | | | | |
|---|---|---|---|---|---|
| 3,070,280 | A * | 12/1962 | Richmond | B65D 27/16 | 229/80 |
| 4,402,453 | A * | 9/1983 | Regenstein, Jr. | A61L 2/26 | 206/439 |
| 4,483,018 | A * | 11/1984 | Whelan | B65D 33/34 | 229/81 |
| 4,502,599 | A * | 3/1985 | Perecman | B65D 33/001 | 206/526 |
| 4,677,684 | A * | 6/1987 | Gatward | A47G 21/001 | 383/87 |
| 4,785,940 | A * | 11/1988 | Wilson | B65D 33/20 | 383/204 |
| 5,100,000 | A * | 3/1992 | Huseman | B65D 33/2508 | 206/554 |
| 5,267,643 | A * | 12/1993 | Scribner | B65D 33/14 | 206/455 |
| 5,642,605 | A | 7/1997 | Tenner et al. | | |
| 5,683,029 | A * | 11/1997 | Lyons | B65D 27/38 | 229/309 |
| 7,806,594 | B2 | 10/2010 | Trinko | | |
| 7,931,169 | B2 * | 4/2011 | Erekson | A47F 9/042 | 221/307 |
| 8,944,250 | B2 * | 2/2015 | Huffer | B65D 75/5855 | 206/484.2 |

* cited by examiner

*Primary Examiner* — Derek Battisti
(74) *Attorney, Agent, or Firm* — Stinson Leonard Street LLP

(57) ABSTRACT

A plastic bag comprising two panels and a flap joined to one of the panels and configured for folding over the other of the panels for closure of the bag, wherein at least a portion of the flap has a tackiness which is greater than the tackiness of its associated panel. A stack of bags having a flap with greater tackiness than the tackiness of the major panels of the bags.

12 Claims, 20 Drawing Sheets

PLASTIC FOOD PORTION BAG WITH TACKY FLAP

REFERENCE TO RELATED APPLICATION

This application claims priority to U.S. provisional application 61/968,882 filed Mar. 21, 2014, the entire disclosure of which is expressly incorporated herein by reference.

FIELD OF THE INVENTION

This invention is directed to a plastic food portion bag and inventory system.

BACKGROUND OF THE INVENTION

U.S. Pat. No. 5,642,605 discloses a food portion inventory system which employs a series of plastic food storage bags. The bags have a flap at 16 and a rear panel portion 12 which cooperate to provide closure.

U.S. Pat. No. 7,806,595 discloses a deli bag and stack which has adhesive strips at 32 which secure the bags in the stack and also provide closure.

SUMMARY OF THE INVENTION

The invention is directed to a flip type food storage bag wherein at least a portion of the closure flap has a tackiness which is greater than the tackiness of its associated panel.

The invention is also directed to a flip type food storage bag wherein at least a portion of the closure flap has a tackiness which is greater than the tackiness of its associated panel, and wherein the closure flap has a color which is different from the color of the major panels of the bag.

In another aspect, the invention is directed to a food portion inventory system employing flip type bags as described herein.

Figure 9:
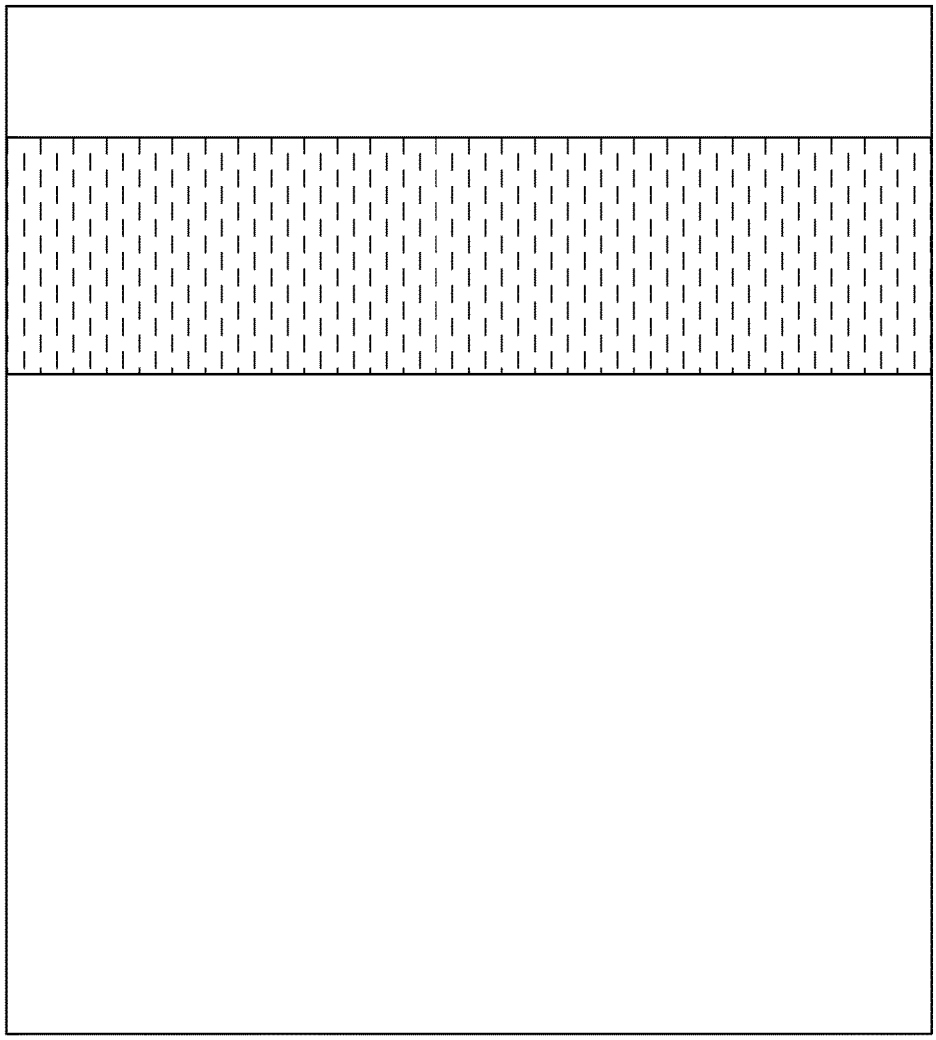
FIG. 9 is a front elevation of a second embodiment of the invention, the front flap of the plastic bag being lined for the color violet.
Figure 10:
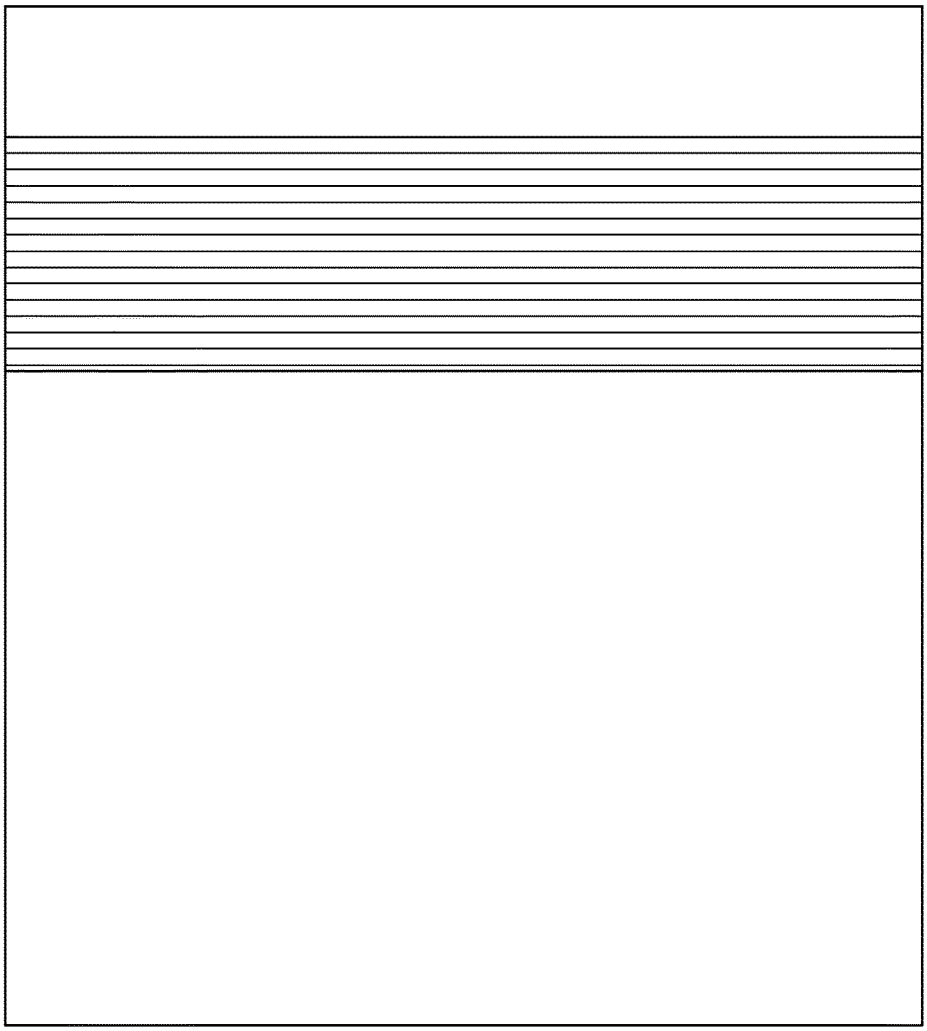
FIG. 10 is a front elevation of a third embodiment of the invention, the front flap of the plastic bag being lined for the color blue.
Figure 11:
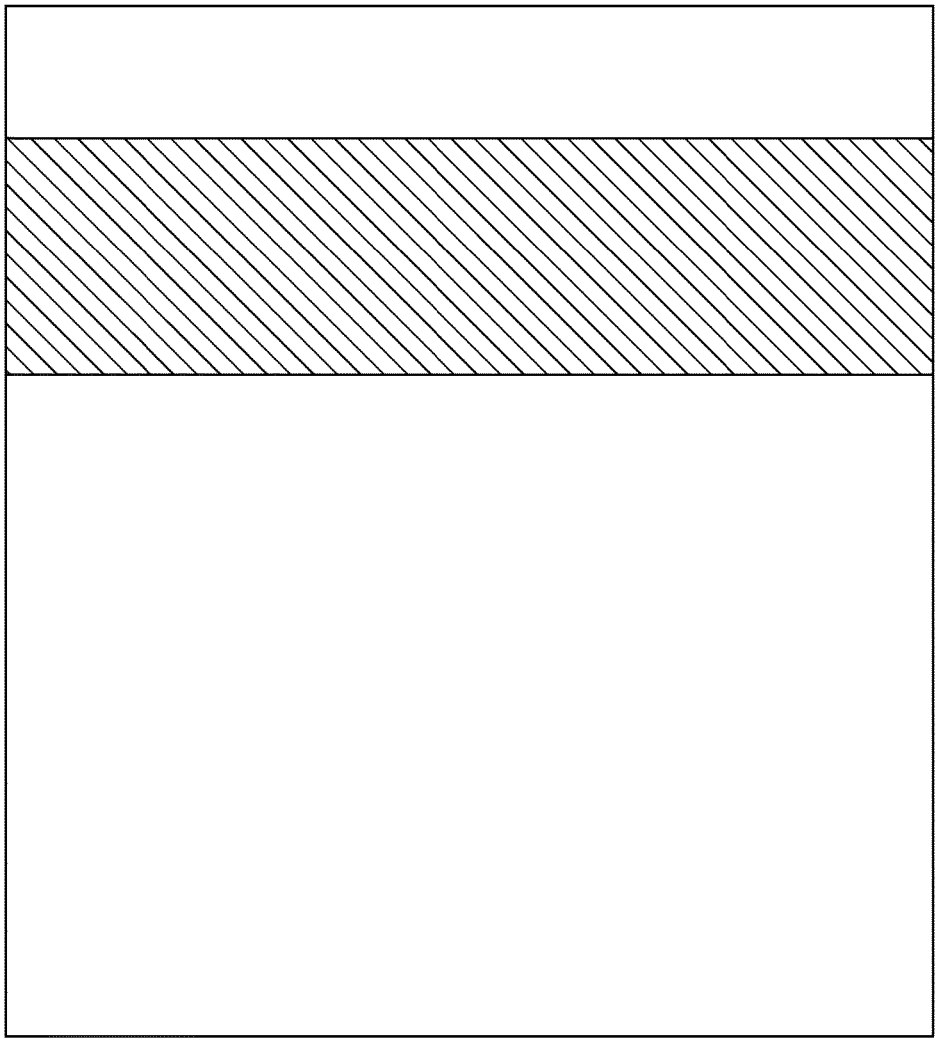
FIG. 11 is a front elevation of a fourth embodiment of the invention, the front flap of the plastic bag being lined for the color green.
Figure 12:
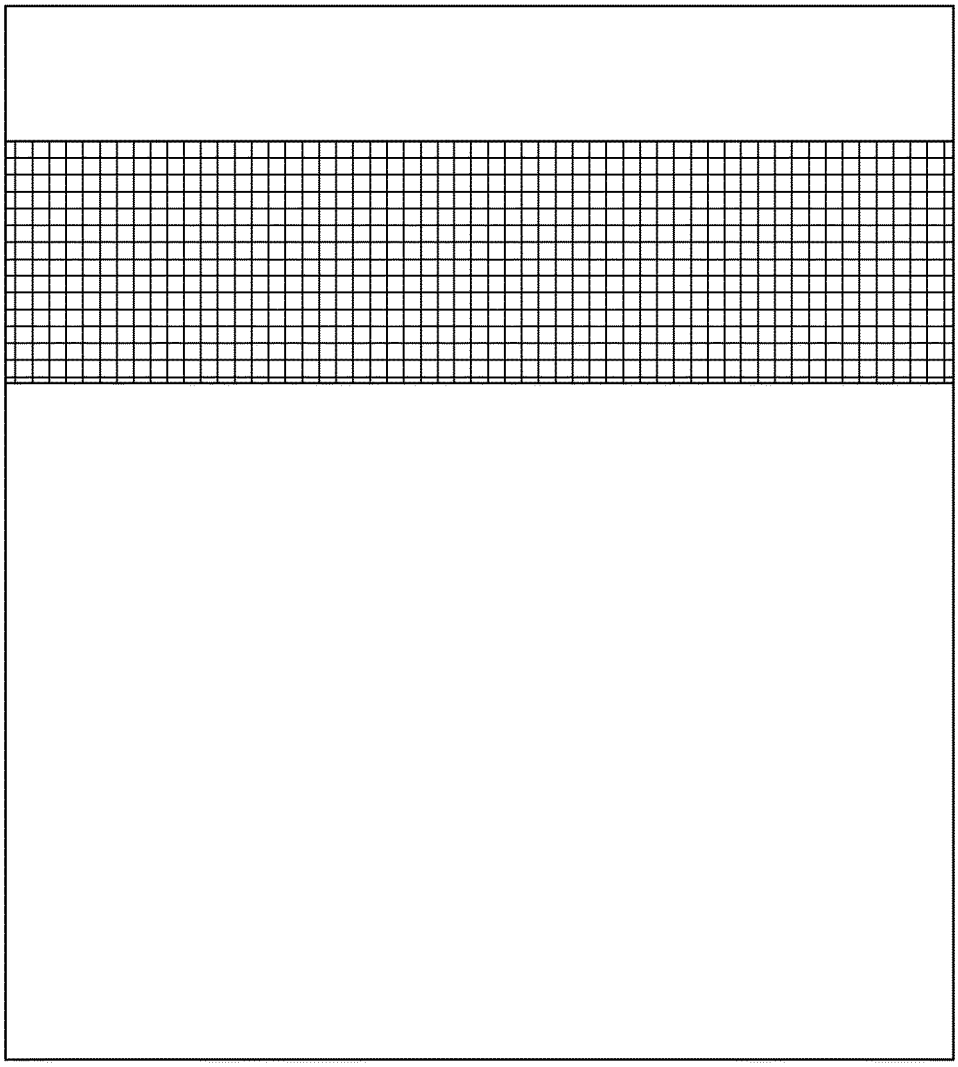
FIG. 12 is a front elevation of a fifth embodiment of the invention, the front flap of the plastic bag being lined for the color yellow.
Figure 13:
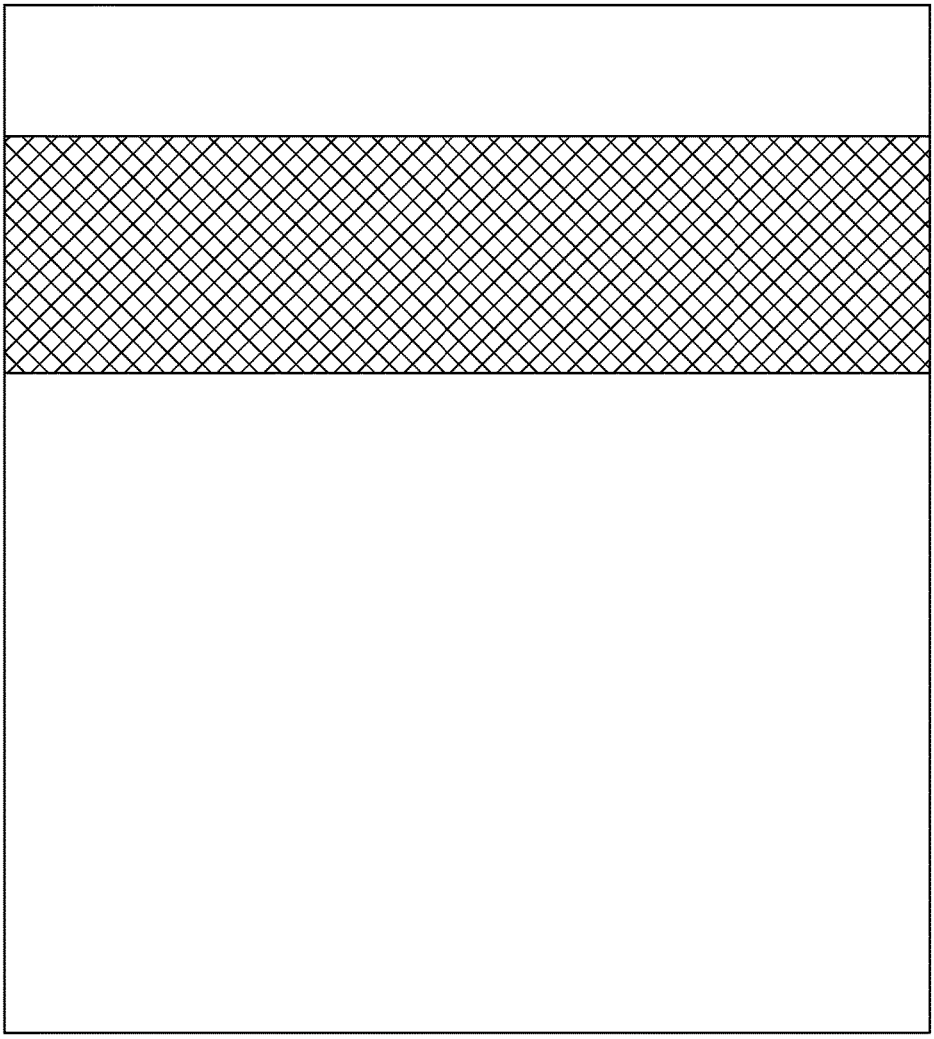
FIG. 13 is a front elevation of a sixth embodiment of the invention, the front flap of the plastic bag being lined for the color orange.
Figure 14:
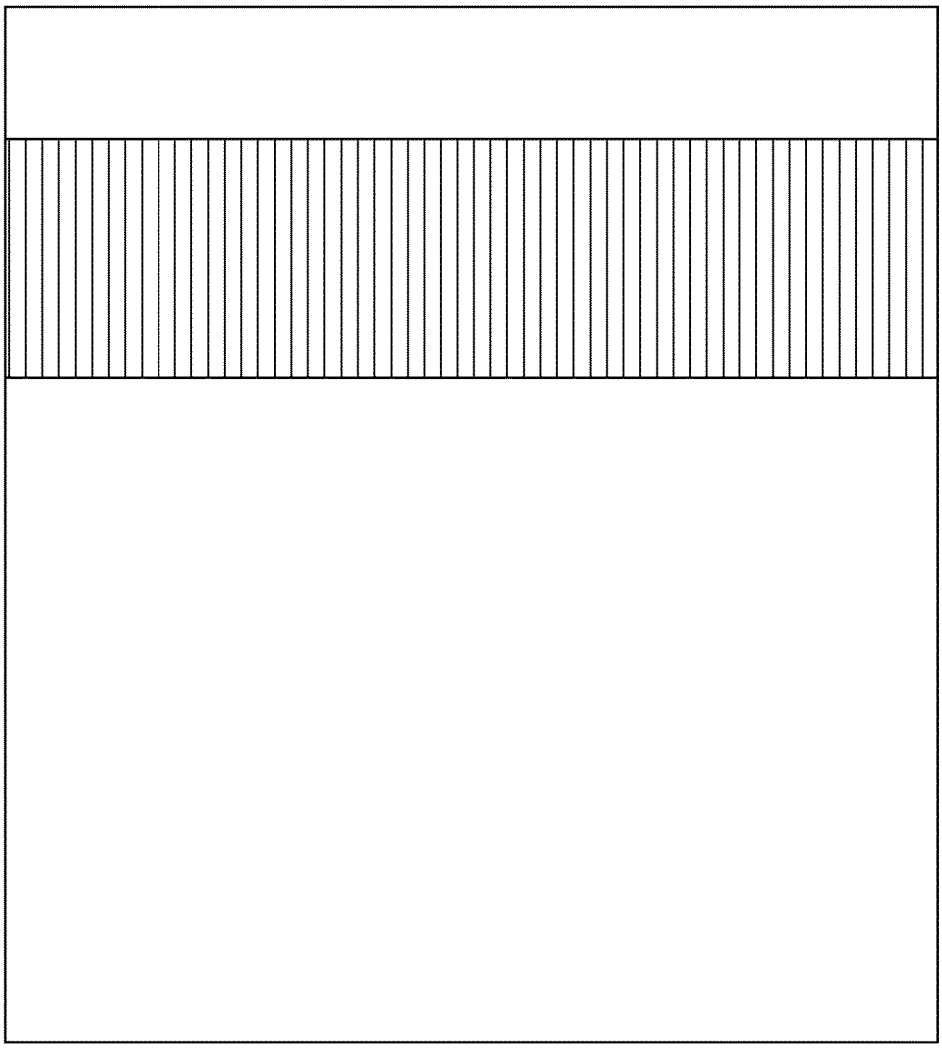
FIG. 14 is a front elevation of a seventh embodiment of the invention, the front flap of the plastic bag being lined for the color red.
Figure 15:
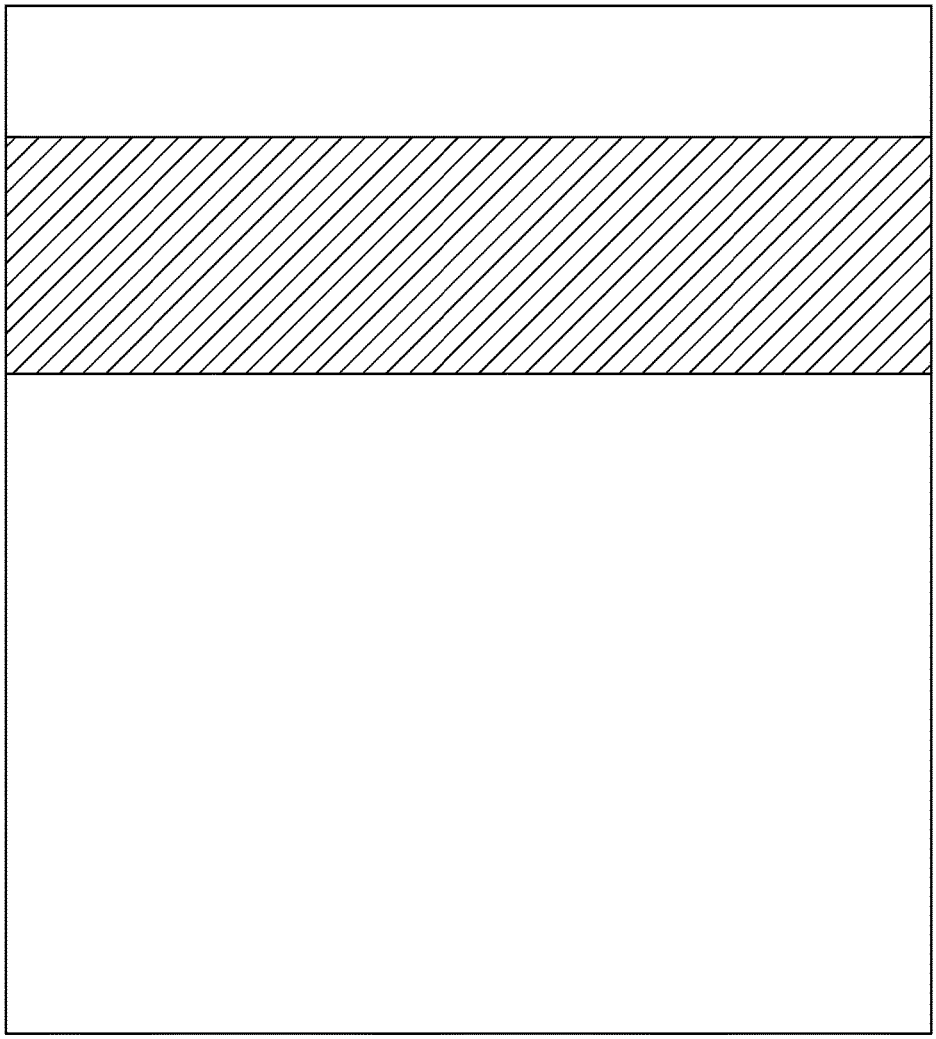
FIG. 15 is a front elevation of an eighth embodiment of the invention, the front flap of the plastic bag being lined for the color brown.
Figure 16:
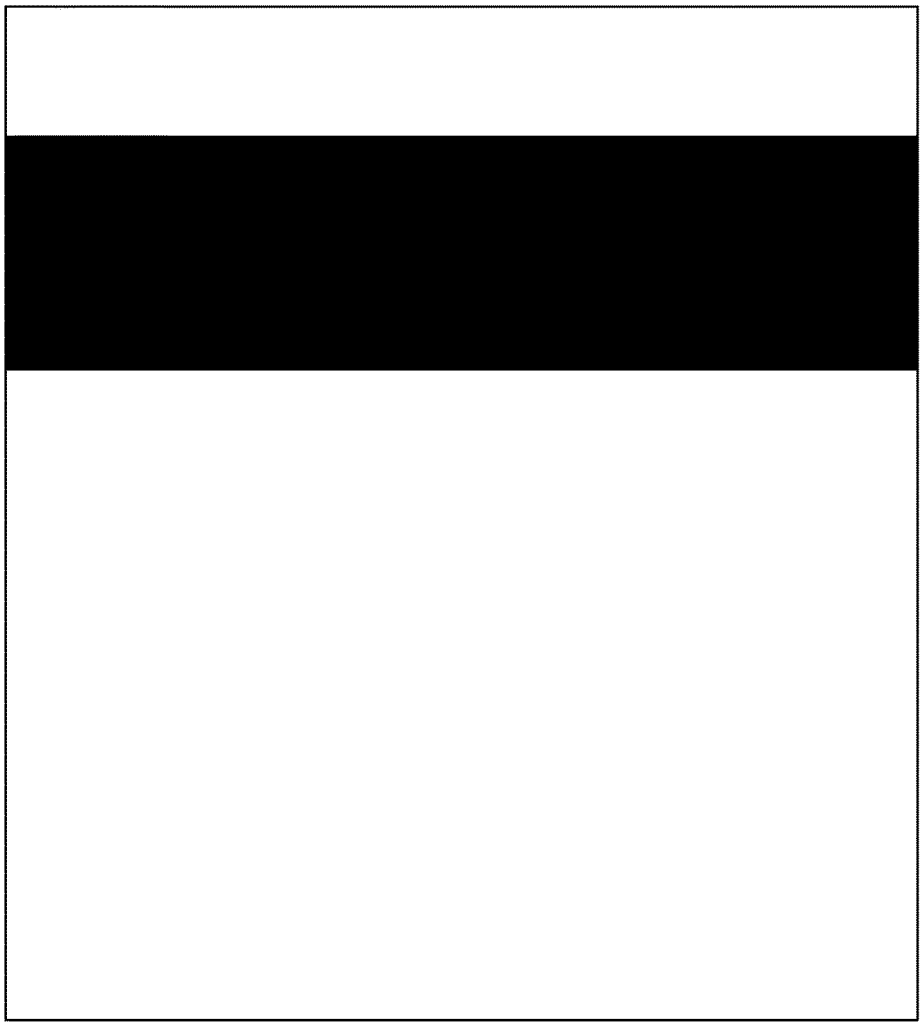
FIG. 16 is a front elevation of a ninth embodiment of the invention, the front flap of the plastic bag being lined for the color black.
Figure 17:
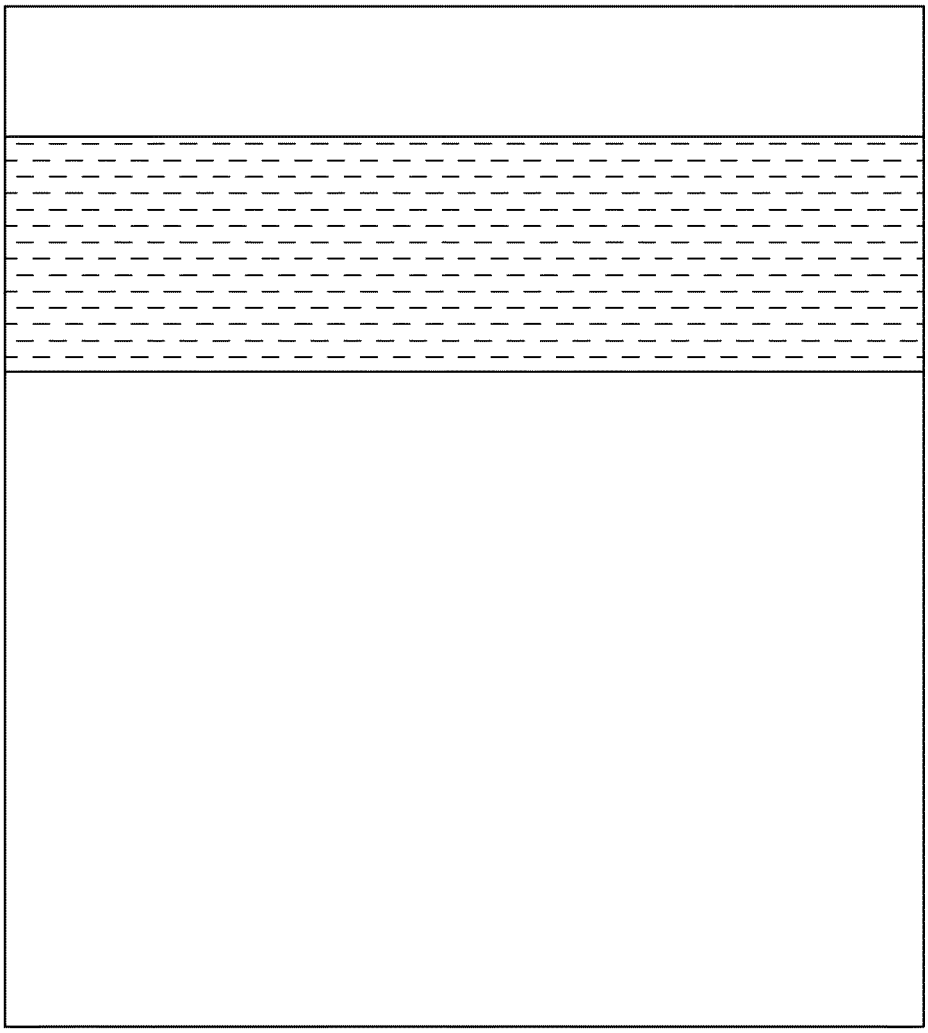
FIG. 17 is a front elevation of a tenth embodiment of the invention, the front flap of the plastic bag being lined for the color gray.
Figure 18:
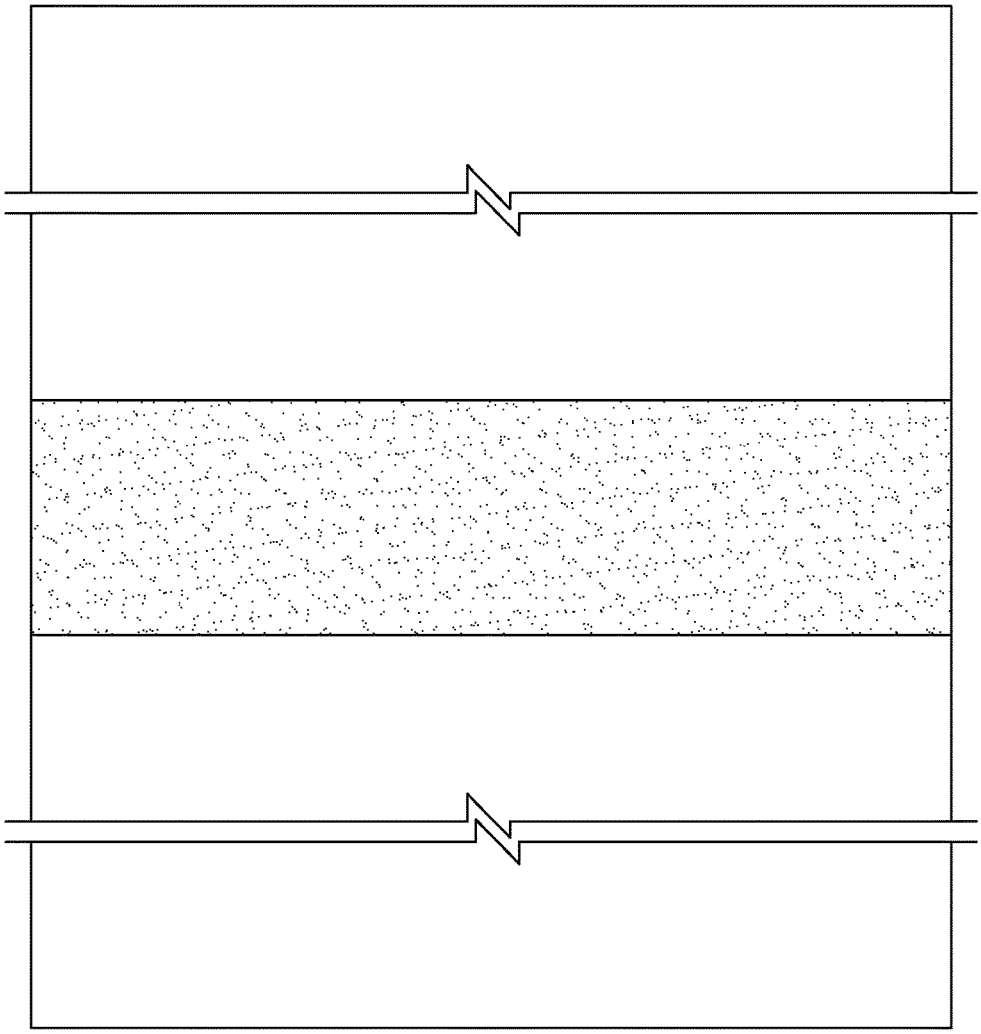
FIG. 18 is a front elevation of an eleventh embodiment of the invention, the plastic bag having a color strip.
Figure 19:
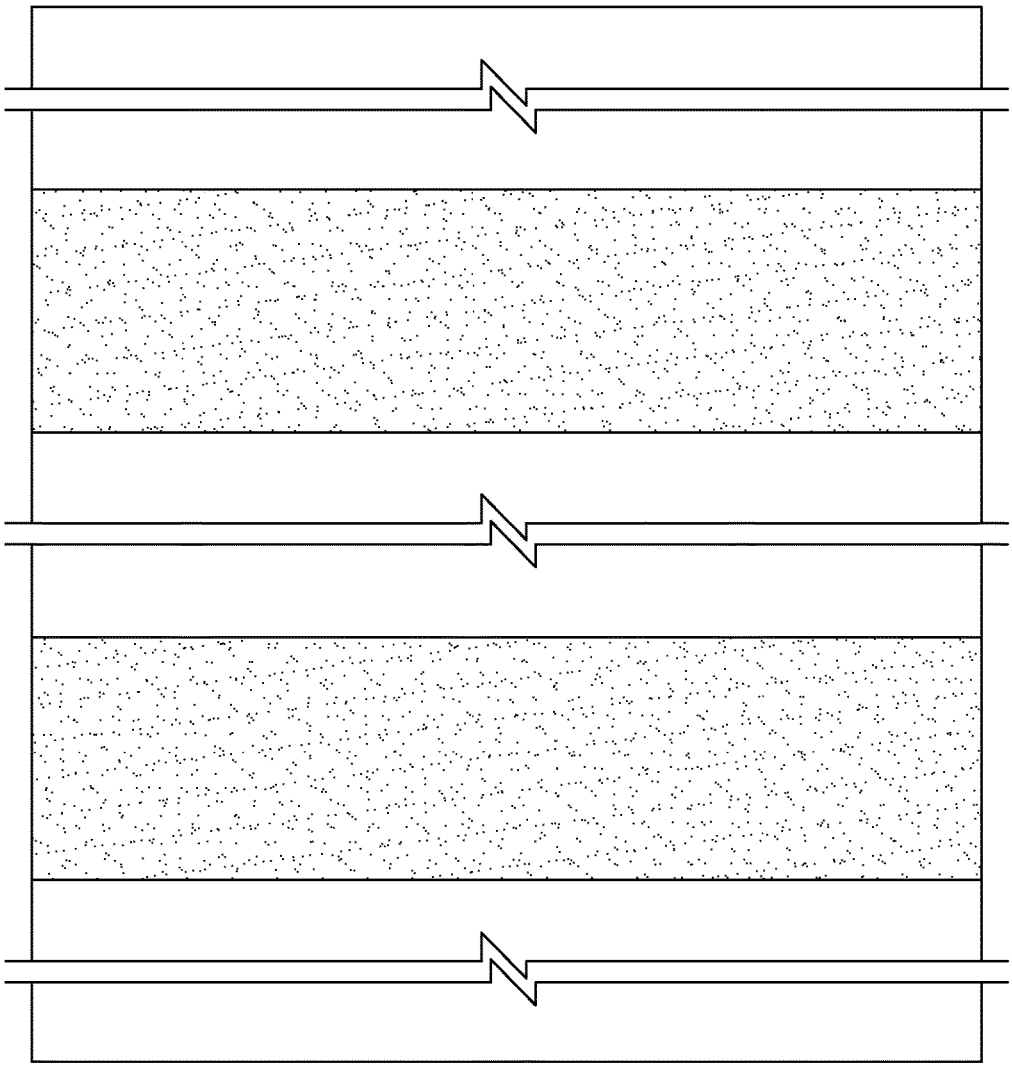
FIG. 19 is a front elevation of a twelfth embodiment of the invention, the plastic bag having two color strips.

Another embodiment is the same as in FIG. 9 except that in this embodiment the front flap of the plastic bag is lined for the color purple;

Another embodiment is the same as in FIG. 12 except that in this embodiment the front flap of the plastic bag is lined for the color gold;

Another embodiment is the same as in FIG. 14 except that in this embodiment the front flap of the plastic bag is lined for the color pink; and Another embodiment is the same as in FIG. 17 except that in this embodiment the front flap of the plastic bag is lined for the color silver.

Figure 1:
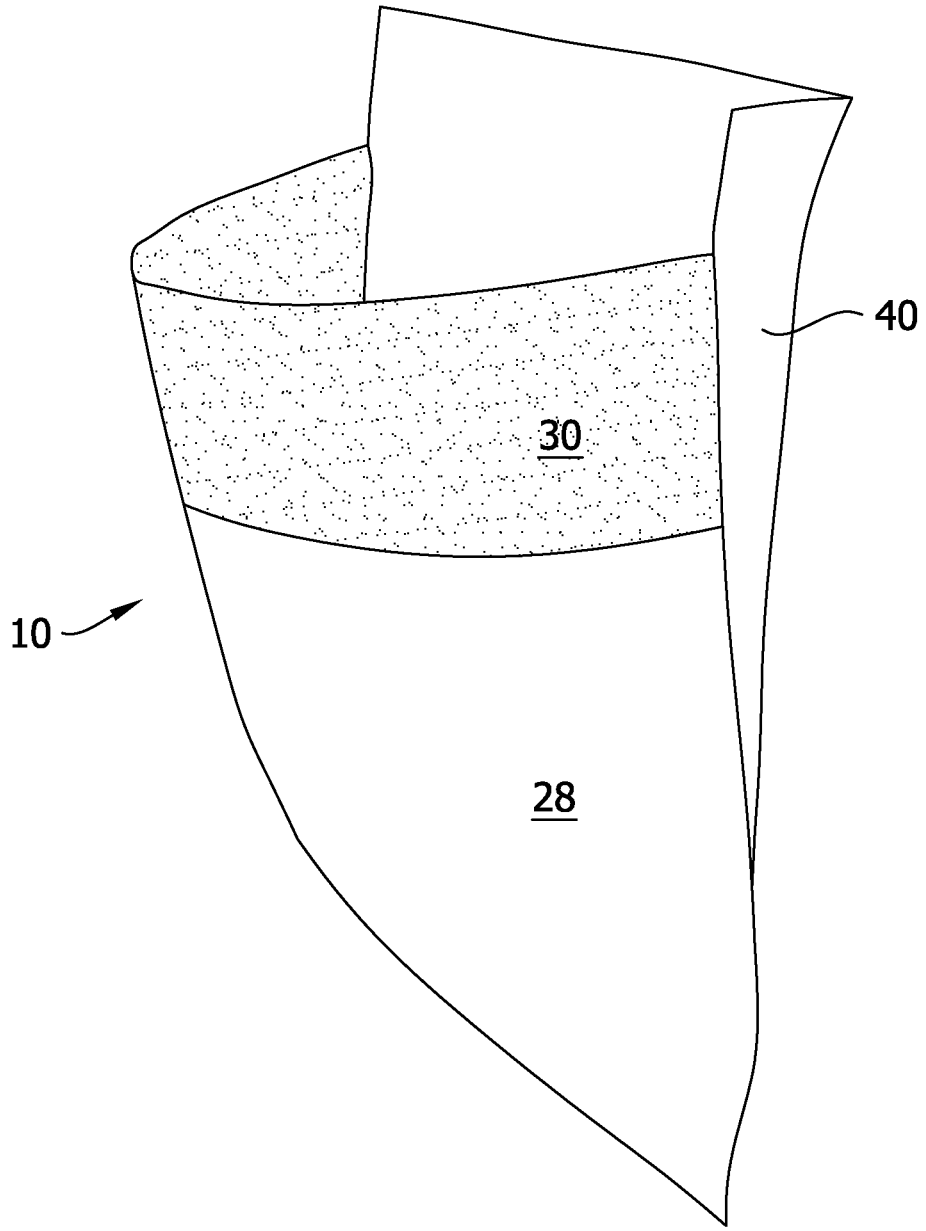
FIG. 1 is a perspective of a plastic bag of the present invention having a tacky segment on a front flap of the plastic bag.

The shading in FIGS. 1-8 depicts a color contrast consonant with the visual appearance shown in these drawings. In FIG. 1, a front panel and a rear panel of the plastic bag are transparent, and a front flap of the plastic bag has stippling to show that it has color, and therefore a color contrast is depicted between the colored front flap and the transparent front and rear panels.

The top, bottom, left, and right views of the alternative embodiments in FIGS. 9-16 are as shown in FIGS. 4-8, except that the front flap has the specific color shown in the embodiments of FIGS. 9-16, respectively.

DETAILED DESCRIPTION OF PREFERRED EMBODIMENTS

A preferred embodiment of the invention is depicted in FIG. 1 which shows a co-extruded tacky flap at 30 which is preferably made from a tacky polymer. In one currently preferred embodiment, this tacky flap also has a color which distinguishes it from the remainder of the bag material.

Figure 7:
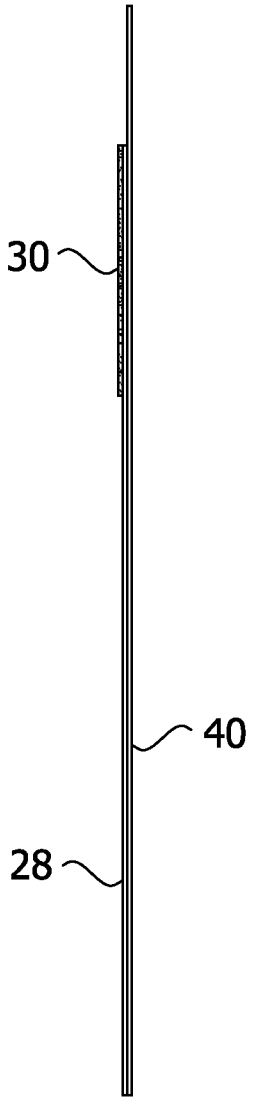
FIG. 7 is a right side elevation.
Figure 7A:
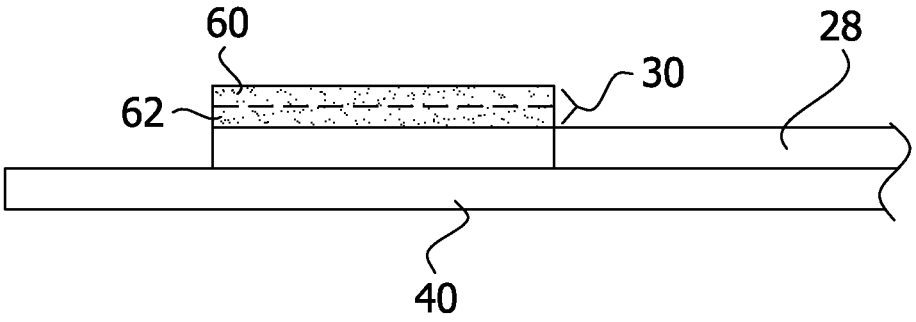
FIG. 7A is a cross section side view.
Figure 8:
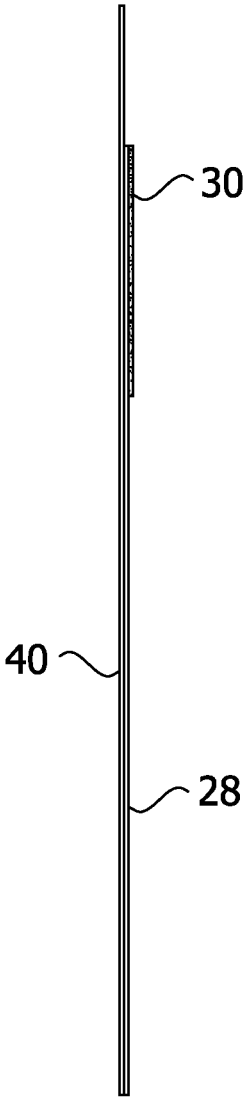
FIG. 8 is a left side elevation.

The plastic bag is preferably made from a thermoplastic material comprising ethylene-based polymers, such as high-density polyethylene (HDPE), although other suitable materials are within the scope of the present invention. The plastic bag includes at least a segment on the flap which assists to provide a seal to the back of the bag when the flap is folded over the opening. In one embodiment, this is accomplished by manufacturing the bag so that the flap 30 is relatively tacky in comparison to a relatively smooth surface of the remainder of the bag, the relatively smooth surface having a relatively low COF. The flap 30 in one embodiment is made of a material or at least contains a material with a higher coefficient of friction than the remainder of the bag. For example, in one embodiment the flap 30 has an upper layer which is preferably made from a polyethylene of lower density than the HDPE used to make the remainder of the bag; for example the flap 30 comprises or is made from a material such as low density polyethylene (LDPE), linear low density polyethylene (LLDPE), ethylene copolymers (such as ethylne vinyl acetate copolymer), or metallocene polyethylene or ethylene copolymer, or blends thereof. Examples of suitable metallocene lower density polyethylenes or ethylene copolymer include VISTAMAXX sold by Exxon Mobil, AFFINITY sold by The Dow Chemical Company, and ENGAGE sold by the Dow Chemical Company. For example, in one embodiment the smooth portions of the bag are made from HDPE film having a density of greater than about 0.935 g/cm$^3$, and the top layer of flap 30 is made from low density polyethylene having a density below about 0.935 g/cm$^3$. In one such embodiment, the flap 30 has a top layer of tacky material designated 60 and a bottom layer of less tacky material designated 62 such as HDPE, as shown in FIG. 7A, where 28 is the bag front panel, and 40 is the bag back panel. One current embodiment uses HDPE as the only polyethylene for the bulk material for the major panels, with conventional additives therein such as slip, antistatic, and antiblock; the same composition for the flap material lower layer; and 85% C4 LLDPE+15% PIB (polyisobutylene) concentrate for the flap material upper layer (plus optional colorants).

Using polyethylenes having different densities provides portions of varying coefficients of friction (COF). Typically, the COF of the smooth portions is less than about 0.3 or from about 0.1 to about 0.3 (e.g., about 0.1). The COF of the flap 30 in one embodiment is at least about 0.5 or from about 0.5 to about 1.0.

As an alternative to using polyethylenes having different densities, the relatively smooth surface and relatively tacky surface can be imparted by incorporating one or more surface modification agents into the film used to prepare the plastic bag. Suitable surface modification agents for this purpose include slip additives and anti-block additives for the smooth surface and tackifiers for the tacky flap segment. For example, polyisobutylene (PIB), glyceryl mono-oleate, or other tackifiers added into a polymeric resin such as LDPE, LLDPE, and EVA imparts tackiness. In this manner, the relatively smooth portions and relatively tacky portions of the films used to construct the plastic bag are modified by virtue of the presence of one or more components (i.e., are chemically modified). However, using polyethylenes having different material properties as described is preferred.

Figure 2:
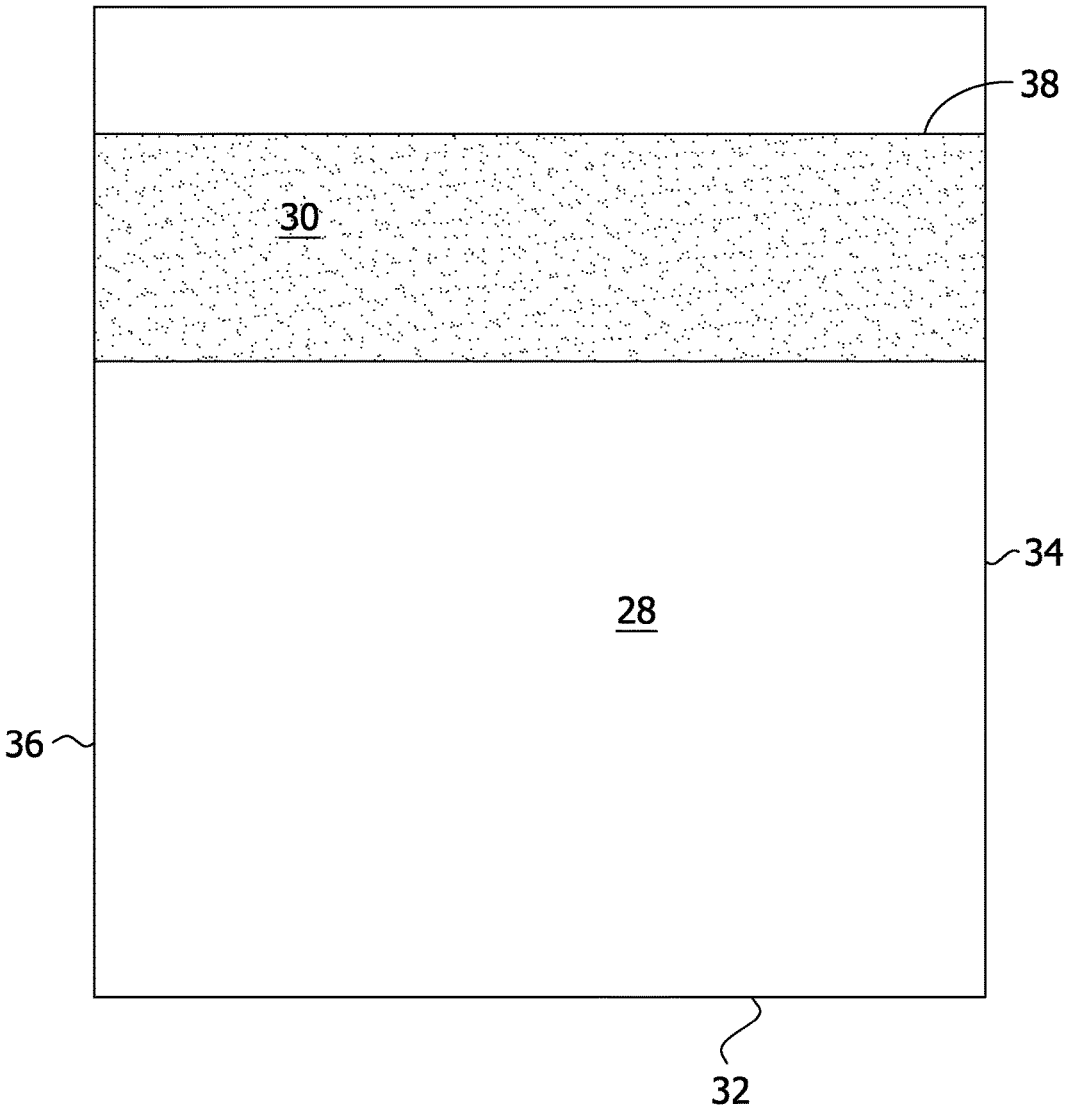
FIG. 2 is a front elevation of the plastic bag of FIG. 1.
Figure 21:
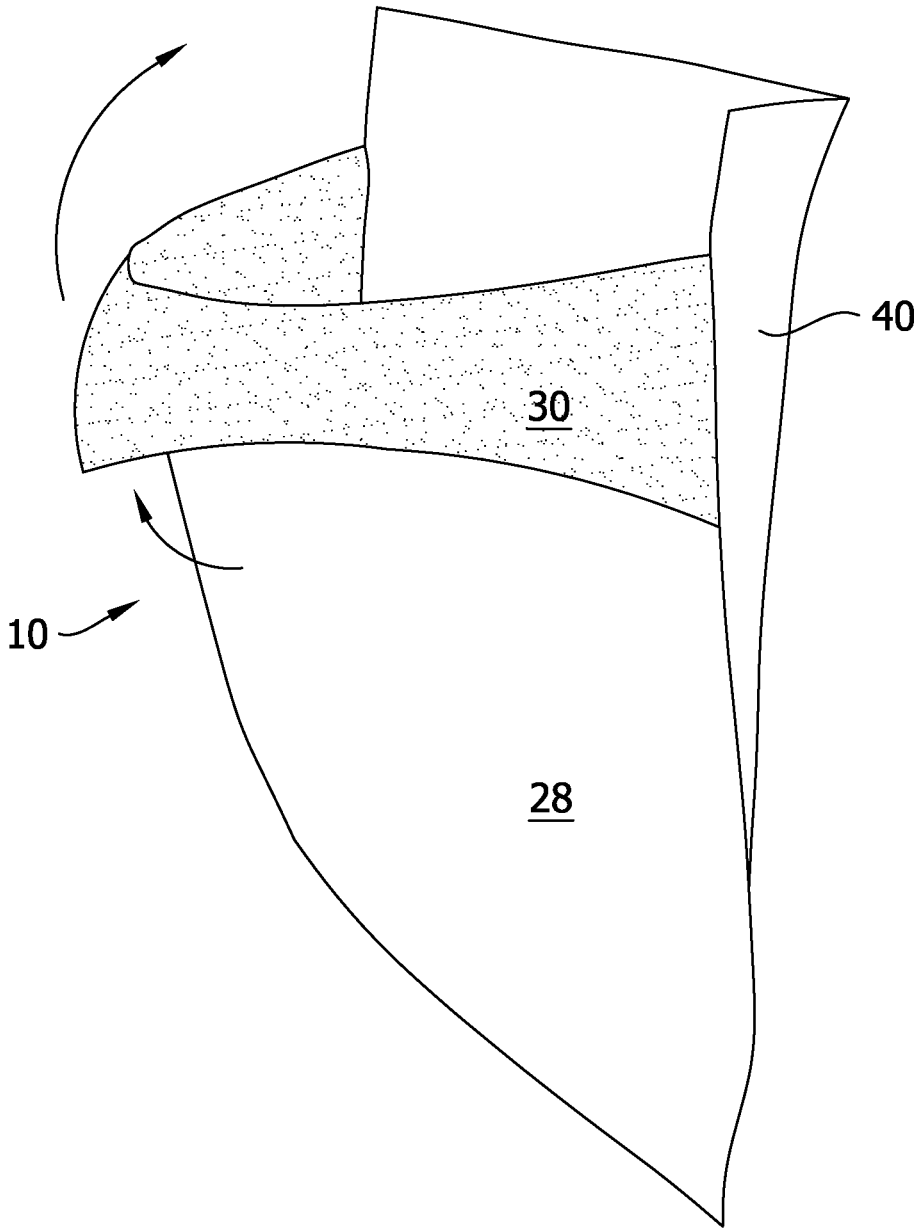
FIG. 21 is a perspective view of the plastic bag of the invention with a front flap being folded over as described below.

It can be seen in the front view in FIG. 2 that a first panel 28 which here is the front panel has a bottom edge 32, first and second side edges 34, 36, and a top edge 38. The first panel bottom edge 32 and top edge 38 are opposite each other and the first panel first and second side edges 34 and 36 are opposite each other. A flap 30 is joined to one of the panels, here to the front panel and configured for folding over the other of the panels for closure of the bag. See FIG. 21. At least a portion of the flap 30 has a tackiness which is greater than the tackiness of its associated panel 28. In particular, in one embodiment, the entire surface area of the flap has the greater tackiness. In other embodiments, less than the entire surface area of the flap has the greater tackiness, for example, one or two or more strips on the flap which strips occupy less than the entire flap have the greater tackiness. For example, one or two strips occupying between 5 and 60%, such as between 5 and 25% of the surface area of the flap have the greater tackiness in one embodiment. In a currently preferred embodiment, the greater tackiness of the entire surface area or one or more strips is provided in the outer layer of the flap and not in the lower layer of the flap, as described above and shown in FIG. 7A.

Figure 3:
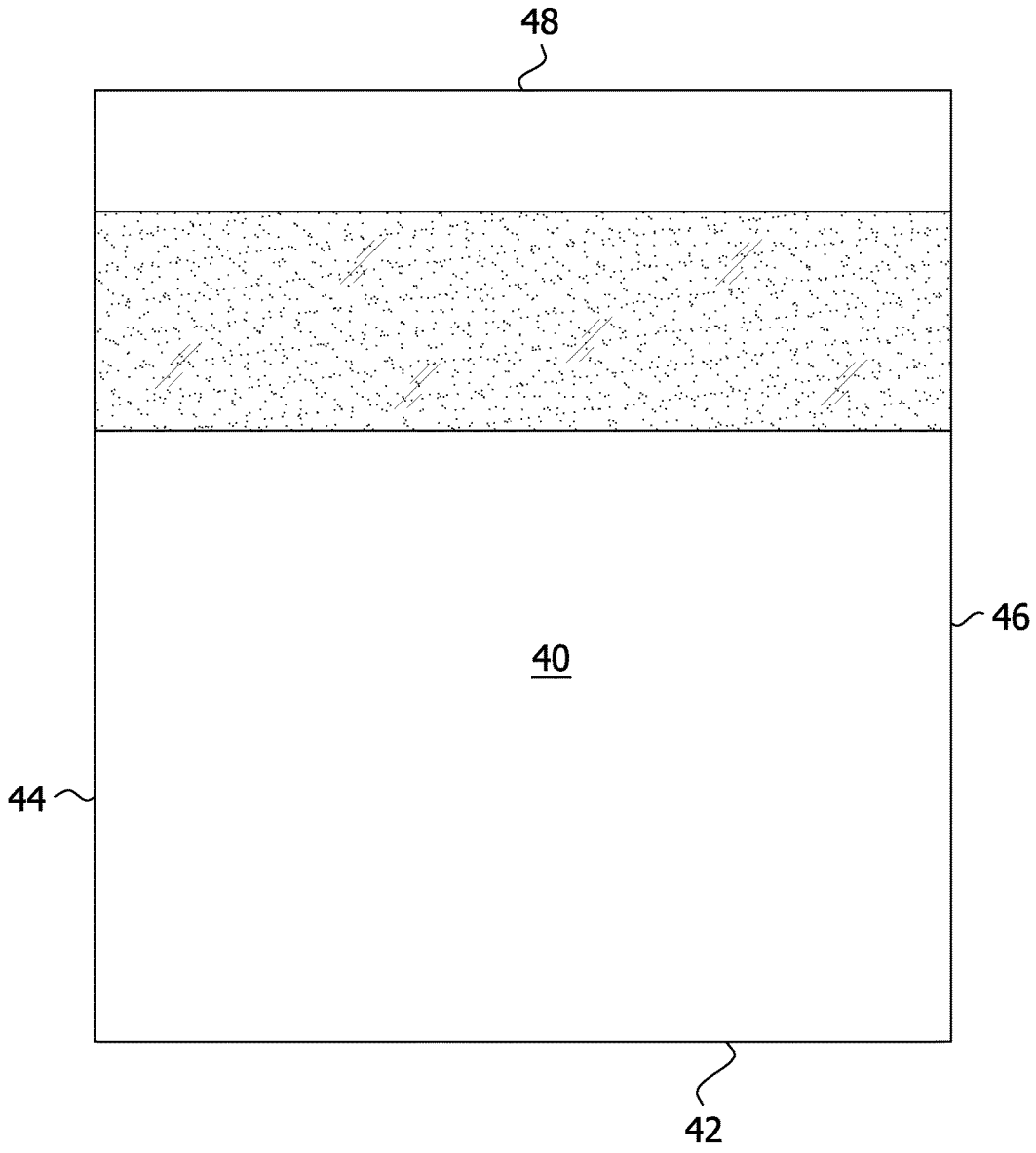
FIG. 3 is a rear elevation.

The rear view in FIG. 3 shows a second panel 40 which here is the rear panel has a bottom edge 42, first and second side edges 44 and 46, and a top edge 48, with the second panel bottom edge 42 and top edge 48 being opposite each other and the first panel first and second side edges 44 and 46 being opposite each other. The first and second panels are joined to each other along the respective bottom edges and first and second side edges to define a bag interior. The first and second panels 28 and 40 define an opening between the respective top edges permitting access to the bag interior. Flap 30 is joined to one of the panels, here the first/front panel, and configured for folding over the other of the panels for closure of the bag. See FIG. 21. At least a portion of the flap 30, as discussed herein, has a tackiness which is greater than the tackiness of panels 28 and/or 40.

The co-extruded flap 30 in the preferred embodiment, as noted, is a color other than the color of the remainder of the bag. The color of the remainder of the bag may be natural, or transparent as noted above, or a particular color such as light blue or the like. FIGS. 9 through 19 illustrate some of the contemplated variations on this theme.

When the food or the like is inserted into the bag 10, flap 30 shown in FIG. 1 is flipped over (See FIG. 21), pressed and attached to the exterior surface of panel 40 to seal the bag. This is in contrast to currently available food portion bags in which the flap covers the bag mouth but does not seal.

Figure 4:
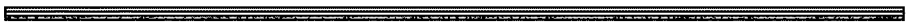
FIG. 4 is a bottom plan.
Figure 5:
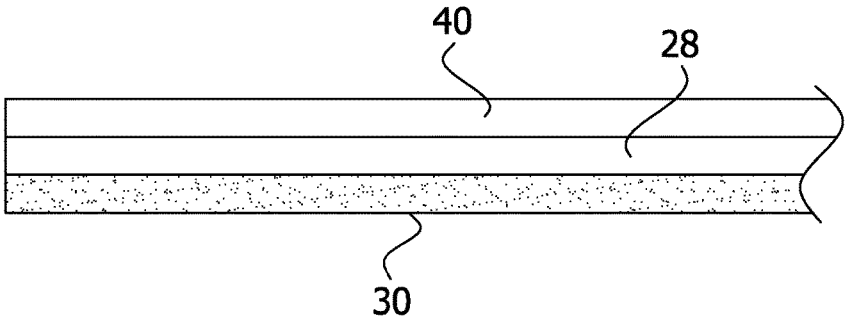
FIG. 5 is a magnified detailed view of part of FIG. 4.
Figure 6:
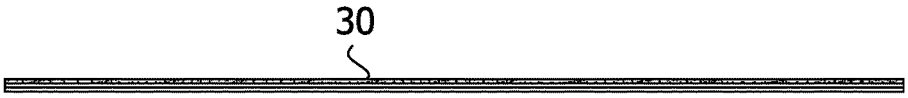
FIG. 6 is a top plan.
Figure 20:
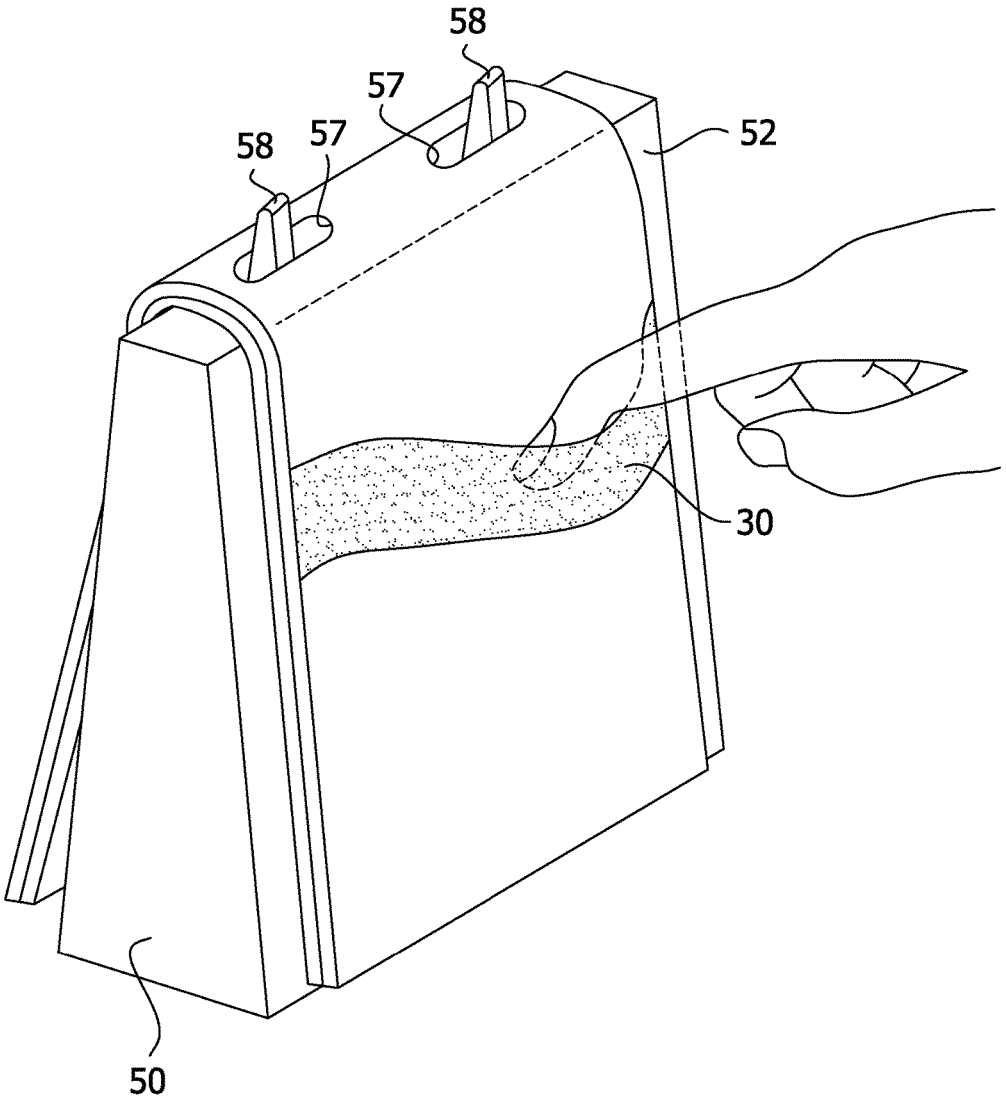
FIG. 20 is a perspective view of a stack of multiple food portion bags in accordance with this invention.

In the preferred embodiment, the food portion bags are generally provided in a stack like FIG. 20 herein and FIGS. 4 and 5 in U.S. Pat. No. 7,806,594. The stack sits on rack 50 laying over front face 52 of the rack, with posts 58 of the rack protruding through openings 58 in the bag stack. In the food portion bag stack of the invention, the sticky flap 30 of the portion bag shown in FIG. 1 attaches to exterior surface 40 the previous bag and aligns the entire bag pack. When a top bag is removed, the attachment between exterior surface 40 of the bag and flap 30 of the subsequent bag assists in automatically opening the mouth of the subsequent bag. That is, the tackiness of the flaps helps retain the stack in alignment by adhering one side of each bag to an adjacent bag in the stack, and upon removal of a top bag from the stack, the adherence between the top bag and the adjacent bag on account of the tackiness of the flap pulls the mouth of the adjacent bag open. Furthermore, the sticky surface of flap 30 increases the friction between the finger and the bag helping to open the portion bag mouth.

Rear surface 40 may optionally be treated such as by corona or flame treatment to enhance the attachment and bonding force between the tacky surface 30 and surface 40.

The color of the co-extruded panel 30 functions to distinguish food-packing days in a food inventory system. That is, a bag having a first color flap (e.g., red) is used for storage of food prepared or first stored on Monday; a bag having a second color flap (e.g., blue) is used for storage of food prepared or first stored on Tuesday; etc. Or the different days/colors might be used to designate "use by" days or dates or the like. In each such system, the different colors are used to distinguish between bags in which distinct food batches are to be stored.

The color pigment, for example, red, blue, natural, is preferably added in the tacky material. Accordingly, as with the greater tackiness described herein, the color may occupy the entire surface area of the flap; or the color may occupy less than the entire surface area of the flap, for example, one or two or more strips on the flap which strips occupy less than the entire flap have the color. For example, one or two strips occupying between 5 and 60%, such as between 5 and 25% of the surface area of the flap have the color in one embodiment. Moreover, the flap may have color combinations. For example, the flap may have two color/tacky strips, such as two blue strips, one red strip and one blue strip, one green and one blue strip, etc. With this configuration, an additional option is for one color to designate one factor and another color to designate another factor. For example, one color may indicate a day of the week such as Sunday, Monday, etc., distinct from different colors for other days; and a second color on the flap may indicate another factor such as the bag contents, e.g., beef, pork, etc. The invention also encompasses strips of different width on the same flap and between different embodiments.

In accordance with this invention, the bag is preferably sealable air-tight and liquid-tight. When the flap 30 is flipped and sealed, the bag can be air-tight or water-tight because of the sealing afforded by the tacky surface of 30 in combination with the fact that the flap 30 folds completely over and envelops the mouth of the bag.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

The invention claimed is:

1. A plastic flip type food storage bag comprising:

a first panel having a bottom edge, first and second side edges, and a top edge, with the first panel bottom edge and top edge being opposite each other and the first panel first and second side edges being opposite each other;

a second panel having a bottom edge, first and second side edges, and a top edge, with the first panel bottom edge and top edge being opposite each other and the first panel first and second side edges being opposite each other, the first and second panels being joined to each other along the respective bottom edges and first and second side edges to define a bag interior, the first and second panels defining an opening between the respective top edges permitting access to the bag interior, with the first panel defining a front panel and the second panel defining a rear panel; and a closure flap joined directly to an outwardly facing front of the first panel defining the front panel, the closure flap configured for folding over the front and rear panels and opening for closure of the bag, wherein the entire surface area of the closure flap facing outwardly away from the first panel has a tackiness which is greater than the tackiness of the first panel to which it is joined;

the second panel having an extension section extending above the first panel with the top edge of the second panel above the top edge of the first panel, and the first panel is disposed between the closure flap and the second panel such that the plastic bag is a flip type food storage bag;

wherein the first and second panels comprise high density polyethylene (HDPE) material and have a coefficient of friction of less than 0.3;

wherein the closure flap comprises a material selected from the group consisting of low density polyethylene (LDPE), linear low density polyethylene (LLDPE), ethylene copolymer, metallocene polyethylene and ethylene copolymer, or blends thereof, which composition imparts a coefficient of friction to the outwardly facing surface of the closure flap of at least about 0.5.

2. The plastic bag of claim 1 wherein the entire surface area of the closure flap facing outwardly away from the first panel comprises said material selected from the group consisting of low density polyethylene (LDPE), linear low density polyethylene (LLDPE), ethylene copolymer, metallocene polyethylene and ethylene copolymer, or blends thereof.

3. The plastic bag of claim 1 wherein the flap comprises more than one layer including an outer layer consisting of a material which imparts said greater tackiness.

4. The plastic bag of claim 1 wherein said entire surface area of the closure flap facing outwardly has a coefficient of friction of from about 0.5 to about 1.0.

5. The plastic bag of claim 1 wherein the flap has a color different from a color of the rest of the bag.

6. The plastic bag of claim 1 wherein the flap has a color and the first and second panels are transparent.

7. The plastic bag of claim 1 wherein the first and second panels consist of a material in which high density polyethylene (HDPE) is the only polyethylene component.

8. The plastic bag of claim 1 wherein:

the second panel is larger than the first panel, such that the opening of the bag is offset from the top edge of the second panel;

the closure flap is joined directly to the first panel along a top edge and two side edges;

the first panel and second panel are transparent.

9. The plastic bag of claim 8 wherein the flap comprises more than one layer including an outer layer consisting of a material which imparts said greater tackiness.

10. The plastic bag of claim 8 wherein the flap has a color different from a color of the first and second panels.

11. A stack of multiple flip type food storage bags comprising:

multiple flip type food storage bags with each bag comprising:

a first panel having a bottom edge, first and second side edges, and a top edge, with the first panel bottom edge and top edge being opposite each other and the first panel first and second side edges being opposite each other;

a second panel having a bottom edge, first and second side edges, and a top edge, with the first panel bottom edge and top edge being opposite each other and the first panel first and second side edges being opposite each other, the first and second panels being joined to each other along the respective bottom edges and first and second side edges to define a bag interior, the first and second panels defining an opening between the respective top edges permitting access to the bag interior with the first panel defining a front panel and the second panel defining a rear panel; and a closure flap joined directly to an outwardly facing front of the first panel defining the front panel, the closure flap configured for folding over the front and rear panels and opening for closure of the bag, wherein the entire surface area of the closure flap facing outwardly away from the first panel has a tackiness which is greater than the tackiness of the first panel to which it is joined;

the second panel having an extension section extending above the first panel with the top edge of the second panel above the top edge of the first panel, and the first panel is disposed between the closure flap and the second panel such that the plastic bag is a flip type food storage bag;

wherein the tackiness of the flaps retains the stack in alignment by adhering one side of each bag to an adjacent bag in the stack;

wherein upon the removal of a top bag from the stack, the adherence between the top bag and the adjacent bag on account of the tackiness of the flap pulls the adjacent bag open; and wherein said entire surface area of the closure flap facing outwardly has a coefficient of friction of at least about 0.5 and the surface of the first and second panels has a coefficient of friction of less than about 0.3.

12. The plastic bag of claim 1 wherein the closure flap on the front panel is configured to fold completely over the rear panel and envelop a mouth of the bag defined by said opening between the respective top edges permitting access to the bag interior.

* * * * *